US008397696B2

(12) United States Patent
Hanjagi

(10) Patent No.: US 8,397,696 B2
(45) Date of Patent: Mar. 19, 2013

(54) COMPREHENSIVE FUEL PRESSURE DAMPER

(75) Inventor: Mahesh Nagesh Hanjagi, Yorktown, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 303 days.

(21) Appl. No.: 12/698,320

(22) Filed: Feb. 2, 2010

(65) Prior Publication Data

US 2011/0186015 A1 Aug. 4, 2011

(51) Int. Cl.
*F02M 63/00* (2006.01)
*F02M 63/02* (2006.01)

(52) U.S. Cl. ..... 123/447; 123/456

(58) Field of Classification Search ..... 123/447, 123/456, 457, 463, 468; 92/94
See application file for complete search history.

(56) References Cited

U.S. PATENT DOCUMENTS 5,590,631 A * 1/1997 Tuckey ..... 123/447
6,032,651 A * 3/2000 Field ..... 123/467
6,182,637 B1 * 2/2001 Kilgore et al. ..... 123/467
6,230,685 B1 * 5/2001 Kilgore et al. ..... 123/467
6,336,442 B1 1/2002 Kilgore

FOREIGN PATENT DOCUMENTS

DE 2913423 A1 10/1980
EP 1099848 A2 5/2001
EP 1099849 A2 5/2001

OTHER PUBLICATIONS

International Search Report dated May 10, 2011, from corresponding International Patent Application No. PCT/US2011/022836.

* cited by examiner

*Primary Examiner* — Mahmoud Gimie

(57) ABSTRACT

A fuel pressure damper (10) includes a housing (14) defining an inlet (40) for receiving fuel from a fuel rail. A cover (12) is coupled to the housing to define an interior space (15). A flexible diaphragm (30) has a periphery (32) secured to at least the housing or the cover and has a freely movable central portion (28) that divides the interior space into first and second isolated chambers (42, 44). The diaphragm has a shaped feature (48) such that the central portion can be displaced over a distance. The inlet communicates with the second chamber (44). A spring cup (26) is in the first chamber (42) and is engaged with the central portion of the diaphragm. A variable rate compression spring (18) is in the first chamber and is disposed between the spring cup and the cover. The central portion of the diaphragm and spring are constructed and arranged to dampen low to high magnitude fuel pressure pulsations in the second chamber.

20 Claims, 2 Drawing Sheets

COMPREHENSIVE FUEL PRESSURE DAMPER

FIELD

The invention relates to fuel supply systems and, more particularly, to a comprehensive fuel pressure damper that changes fuel rail volume such that it is effective at low to high pressure and frequency ranges throughout the entire engine operation mode.

BACKGROUND

Conventional fuel delivery systems in the automotive industry are mostly of the returnless type. As a consequence, these systems require an energy absorbing device to mitigate fuel pressure pulsations and/or audible noise generated in the fuel rail due to the normal sequential firing of injectors. This energy absorbing device, commonly known as a fuel pressure damper, is conventionally mounted on the fuel rail.

Most fuel pressure dampers used today are a mere modulate of pressure regulators, hence they do not fulfill the requirement of fuel rail volume change at all levels of engine operation, i.e., all rpms. Almost all conventional dampers have very little movement of the spring and the diaphragm system. Conventional fuel pressure dampers can be tuned to only a limited operating range. These dampers thus help to minimize the pressure pulsation problem in only one range, whereas the fuel system is left desiring at other operating ranges, which may be a nuisance of equal or lesser severity. The current alternative is to choose either a high frequency range or a low frequency range and tune the damper to the more damaging range. This drawback is getting increasingly magnified in today's trend of fuel systems moving towards a higher pressure and frequency range.

The limitations of conventional dampers arise from both the spring and the diaphragm. Conventional helical compression springs are effective and respond equally only to a small window of load. Another important limiter in current dampers is the diaphragm. Conventional diaphragms are flat and have very little displacement, thus limiting their contribution in making a significant volume change. These diaphragms are mainly dependent on the spring for a significant volume change and are also vulnerable to failure upon exposure to overload or higher magnitude pressure pulsations.

Thus, there is a need to provide a fuel pressure damper that is effective in the entire engine operating range of pressure and frequency.

SUMMARY

An objective of the present invention is to fulfill the need referred to above. In accordance with the principles of an embodiment, this objective is obtained by providing a fuel pressure damper including a housing defining an inlet constructed and arranged to receive fuel from a fuel rail. A cover is coupled to the housing to define an interior space. A flexible diaphragm has a periphery fixedly secured to at least the housing or the cover and has a freely movable central portion that divides the interior space into first and second isolated chambers. The diaphragm has a shaped feature such that the central portion can be displaced over a distance. The inlet communicates with the second chamber. A spring receiving structure is in the first chamber and is engaged with the central portion of the diaphragm. A compression spring is in the first chamber and is disposed between the spring receiving structure and the cover. The spring has a variable spring rate and biases the spring receiving structure and thus the diaphragm to a normal position thereby defining a certain volume in the second chamber. In an operating position, the central portion of the diaphragm and spring are constructed and arranged to dampen fuel pressure pulsations in the second chamber 1) of a first magnitude range by the central portion of the diaphragm alone, 2) of a second magnitude range, greater than the first magnitude range, by the central portion of the diaphragm together with stiffness of the spring, and 3) of a third magnitude range, greater than the second magnitude range, that causes the central portion of the diaphragm to move, compressing the spring, thereby defining a volume of the second chamber that is greater than the certain volume.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 2:
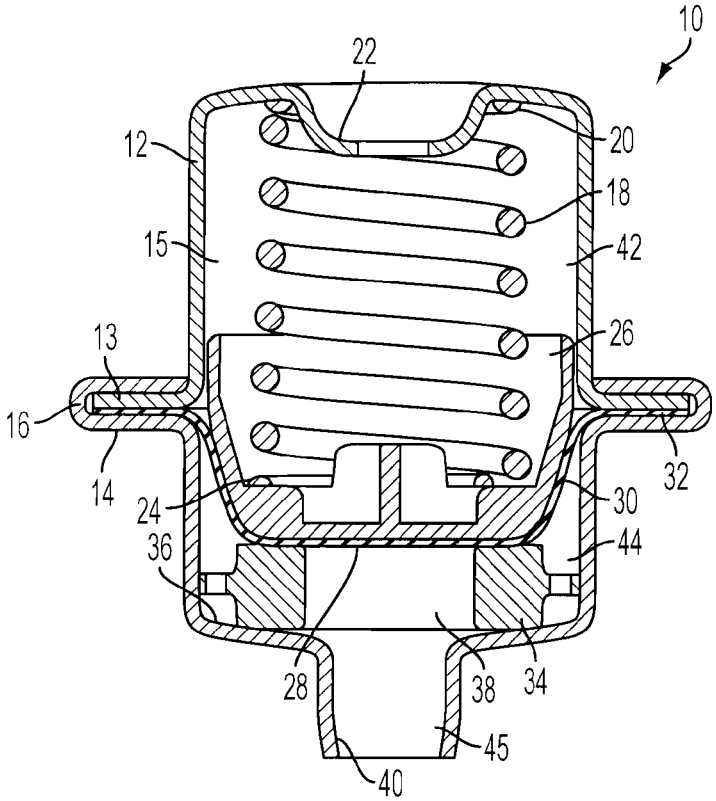
FIG. 2 is a sectional view of the fuel pressure damper of FIG. 1 shown in a normal position.

With reference to FIG. 2, a comprehensive fuel pressure damper is shown generally indicated at 10. The damper 10 includes a cover 12 having an annular flange 13. The flange 13 is secured to a housing 14 by a fold of the housing 14 to form an annular shoulder 16 engaging the flange 13. The shoulder 16 acts as an anchor for the damper 10 during assembly with a fuel rail (not shown). The cover 12 and housing 14 define an interior space 15. A variable rate spring 18 is disposed in the interior space 15. In the embodiment, the spring 18 is preferably a non-linear, conical helical spring having a constant pitch. Disk or other types of variable rate springs can also be employed.

A first end 20 of the spring 18 is held against a detent 22 in the cover 12. A second end 24 of the spring 18 is received in a spring receiving structure, preferably in the form of a spring cup 26. The spring cup 26 is engaged with an upper surface of a freely movable central portion 28 of a flexible, shaped, diaphragm 30. The spring cup 26 ensures that the spring force is distributed evenly on the diaphragm 30 and also ensures that the end 24 of the spring 18 does not contact and damage the diaphragm 30. The diaphragm 30 is considered a means for dampening and is preferably made of rubber or other flexible material suitable for contact with fuel. An annular periphery 32 of the shaped diaphragm 30 is secured to at least the cover 12 or the housing 14. In the embodiment, the periphery 32 is fixedly secured (e.g., sandwiched) between the flange 13 and shoulder 16. The central portion 28 of the diaphragm 30 rests on a spacer 34 which in turn rests on interior surface 36 of the housing 14 in a normal position of the damper 10. The spacer includes a bore 38 to permit the flow of fluid F there-through that is received at inlet 40 of the housing 14.

The diaphragm 30 extends radially and divides the interior space 15 into an upper chamber 42 and a lower chamber 44, isolated from the upper chamber 42. While the upper chamber 42 houses the spring 18 and spring cup 26, the lower chamber 44 provides the means of interaction between fuel and the diaphragm 30. The spring loaded diaphragm 30 keeps the system in equilibrium against fuel pressure pulsations resulting from fuel that enters inlet 40. The inlet 40 defines a chamber 45 that has a volume less than the volume of chamber 44 and thus restricts fuel flow that enters the damper 10.

The comprehensive fuel pressure damper 10 can be assembled to the fuel rail using several conventional methods such as using a clip on the housing shoulder 16 or by using industrial adhesive.

In the normal position of the damper 10 as shown in FIG. 2, the spring 18 pushes against the spring cup 26 and thus the shaped diaphragm 30 is biased towards the inlet 40, with the central portion 28 of the diaphragm 30 engaging the spacer 34. In the normal position, a certain volume is defined in the lower chamber 44. The spring cup 26 is constructed and arranged to be self-centering, thus eliminating the need for additional components to position it within the interior space 15. The configuration of the spring cup 26 also eliminates the need for a central cut in the diaphragm 30. Thus, the central portion 28 of the diaphragm 30 is entirely solid. The spacer 34, resting against surface 36 of the housing 14, maintains a balance point in the normal position of the damper 10.

Figure 1:
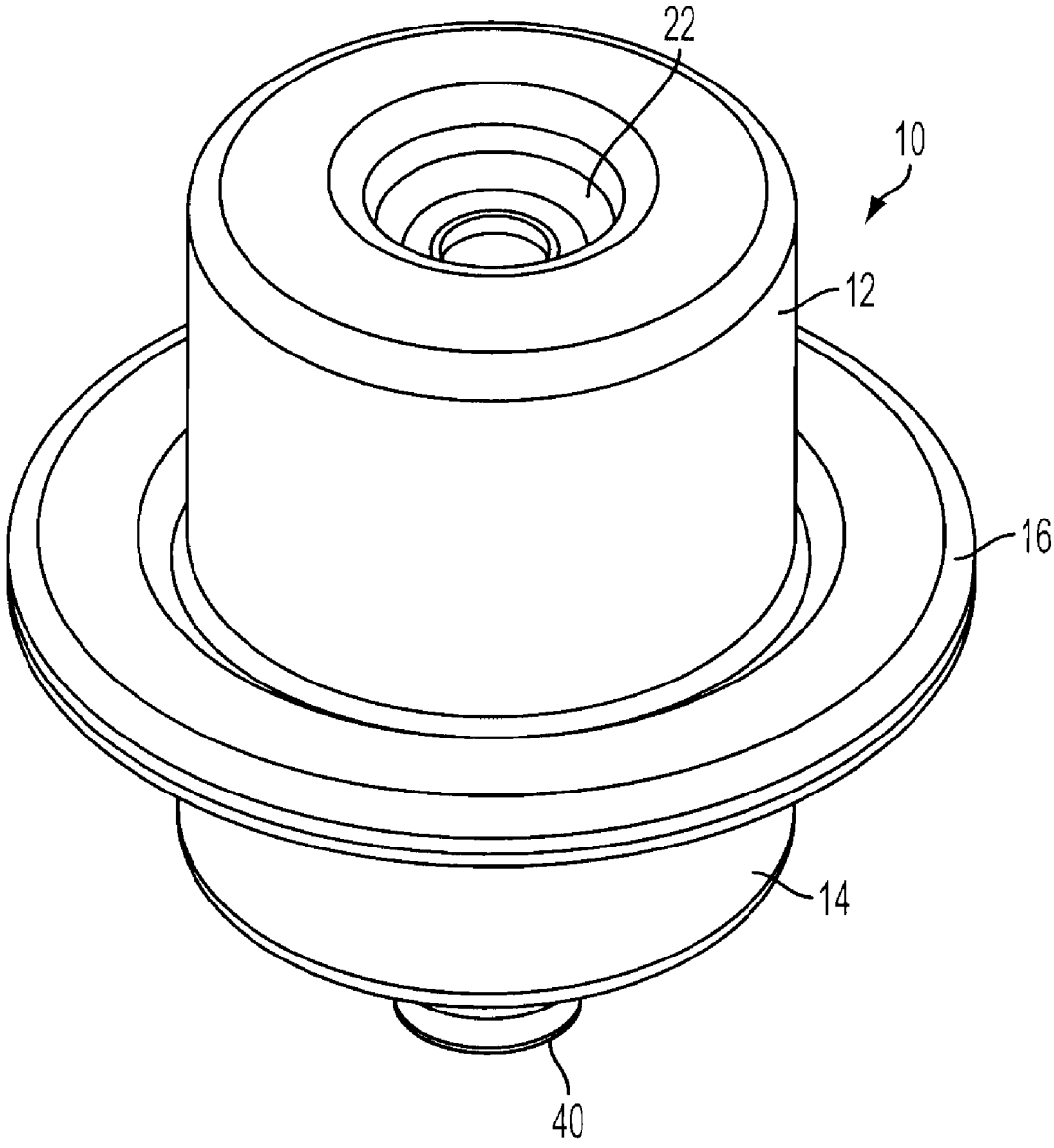
FIG. 1 is a perspective view of a comprehensive fuel pressure damper according to an embodiment.
Figure 3:
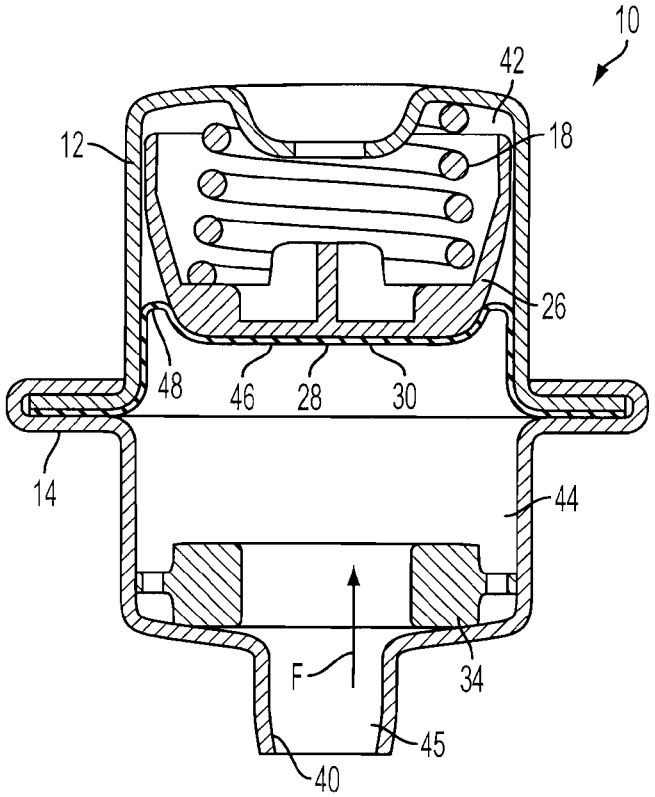
FIG. 3 is a view of the fuel pressure regulator of FIG. 2, but shown in an operating position.

With reference to FIG. 3, in an operating position of the damper 10, the diaphragm 30 alone works against or dampens any fuel pressure pulsations of a very low magnitude range that are received from the fuel rail at inlet 40. For pressure pulsations of low to medium magnitude range, the stiffness of spring 18 works in addition to the diaphragm 30 to dampen the pulsations and cause a change in the fuel rail volume. When the fuel pressure pulsations on surface 46 of the diaphragm 30 are high enough to overcome the force of spring 18 (e.g., in a range greater than the low to medium magnitude range), the diaphragm 30 and spring cup 26 will move or displace. This movement compresses the spring 18, thereby defining a volume of the lower chamber 44 that is greater than the certain volume of FIG. 1 to accommodate the extra influx of fuel into the lower chamber 44.

Advantageously, since the spring 18 has a varying spring rate, a design engineer has the flexibility to calibrate the spring rate over most of the operating frequency range of the damper 10.

The diaphragm 30 has a shaped feature such as at least one convolution 48 (FIG. 3) so that the central portion 28 of the diaphragm 30 can be displaced over a long distance, as shown by the positional difference of the central portion 28 in FIGS. 2 and 3. This significantly contributes in changing the damper volume and absorbing fuel pressure pulsations.

Thus, the integral fuel pressure damper 10 with variable spring rate is used to dampen fuel pressure pulsations generated in a fuel rail of a fuel system used on an internal combustion engine. Sequential opening and closing of injectors during normal operation creates propagating waves or pulses which are undesired and generate noise. As noted above, these pressure pulsations are absorbed by the damper 10 that changes the fuel rail volume in such a manner that it is effective at the lower as well as higher pressure and frequency range throughout the entire engine operation mode.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel pressure damper comprising:

a housing defining an inlet constructed and arranged to receive fuel from a fuel rail, a cover coupled to the housing to define an interior space, a flexible diaphragm having a periphery fixedly secured to at least the housing or the cover and having a freely movable central portion that divides the interior space into first and second isolated chambers, the diaphragm having a shaped feature such that the central portion can be displaced over a distance, the inlet communicating with the second chamber, a spring receiving structure in the first chamber and engaged with the central portion of the diaphragm, and a compression spring in the first chamber and disposed between the spring receiving structure and the cover, the spring having a variable spring rate and biasing the spring receiving structure and thus the diaphragm to a normal position thereby defining a certain volume in the second chamber, whereby in an operating position, the central portion of the diaphragm and spring are constructed and arranged to dampen fuel pressure pulsations in the second chamber 1) of a first magnitude range by the central portion of the diaphragm alone, 2) of a second magnitude range, greater than the first magnitude range, by the central portion of the diaphragm together with stiffness of the spring, and 3) of a third magnitude range, greater than the second magnitude range, that causes the central portion of the diaphragm to move, compressing the spring, thereby defining a volume of the second chamber that is greater than the certain volume, without bypassing from the second chamber any of the fuel that enters the second chamber.

2. The damper of claim 1, wherein the central portion of the diaphragm is entirely solid, having no hole therein, and has a constant thickness.

3. The damper of claim 1, wherein the diaphragm is made of rubber.

4. The damper of claim 1, wherein the shaped feature includes at least one convolution in the diaphragm.

5. The damper of claim 1, wherein the spring is a coil spring.

6. The damper of claim 1, wherein the spring is a non-linear, conical helical spring having a constant pitch.

7. The damper of claim 1, wherein the cover includes an annular flange and the housing includes an annular shoulder coupled to the annular flange.

8. The damper of claim 7, wherein the periphery of the diaphragm is annular and is fixedly secured between the flange and the shoulder.

9. The damper of claim 1, wherein the spring receiving structure is in the form of a cup and the spring is a coil spring having first and second ends, the first end of the spring is engaged with a portion of the cover and the second end of the spring is received in the spring cup.

10. The damper of claim 9, wherein the portion of the cover is a detent in the cover.

11. The damper of claim 1, further comprising a spacer in the interior space and adjacent to the inlet, the central portion of the diaphragm engaging the spacer in the normal position.

12. The damper of claim 1, wherein the inlet defines a chamber that has a volume less than the volume of the second chamber so as to restrict fuel flow entering the damper.

13. A fuel pressure damper comprising:

a housing defining an inlet constructed and arranged to receive fuel from a fuel rail, a cover coupled to the housing to define an interior space, means for dampening having a periphery fixedly secured to at least the housing or the cover and having a freely movable central portion that divides the interior space into first and second isolated chambers, the means for dampening being constructed and arranged such that the central portion can be displaced over a distance, the inlet communicating with the second chamber, and means for biasing the means for dampening to a normal position defining a certain volume in the second chamber, the means for biasing having a variable spring rate and being disposed in the first chamber between the means for dampening and the cover, whereby in an operating position, the central portion of the means for dampening and the means for biasing are constructed and arranged to dampen fuel pressure pulsations in the second chamber 1) of a first magnitude range by the central portion of the means for dampening alone, 2) of a second magnitude range, greater than the first magnitude range, by the central portion of the means for dampening together with the means for biasing, and 3) of a third magnitude range, greater than the second magnitude range, that causes the central portion of the means for dampening to move, causing the means for biasing to move, thereby defining a volume of the second chamber that is greater than the certain volume, without bypassing from the second chamber any of the fuel that enters the second chamber.

14. The damper of claim 13, wherein the means for dampening is a flexible diaphragm having at least one convolution therein, having no hole therein and having a constant thickness.

15. The damper of claim 13, wherein the means for biasing is a non-linear, conical helical spring having a constant pitch.

16. The damper of claim 15, further comprising a spring cup, and wherein the spring has first and second ends, the first end of the spring is engaged with a portion of the cover and the second end of the spring is received in the spring cup.

17. The damper of claim 13, wherein the cover includes an annular flange and the housing includes an annular shoulder coupled to the annular flange.

18. The damper of claim 17, wherein the periphery of the means for dampening is annular and is fixedly secured between the flange and the shoulder.

19. The damper of claim 13, further comprising a spacer in the interior space and adjacent to the inlet, the central portion of the means for dampening engaging the spacer in the normal position.

20. The damper of claim 13, wherein the inlet defines a chamber that has a volume less than the volume of the second chamber so as to restrict fuel flow entering the damper.

* * * * *